US008567555B2

(12) United States Patent
Harvey

(10) Patent No.: US 8,567,555 B2
(45) Date of Patent: Oct. 29, 2013

(54) DUAL BORE CANALPHONE SYSTEM

(76) Inventor: Jerry Harvey, Apopka, FL (US)

( * ) Notice: Subject to any disclaimer, the term of this patent is extended or adjusted under 35 U.S.C. 154(b) by 39 days.

(21) Appl. No.: 13/315,610

(22) Filed: Dec. 9, 2011

(65) Prior Publication Data

US 2013/0146387 A1 Jun. 13, 2013

(51) Int. Cl.
*H04R 7/00* (2006.01)

(52) U.S. Cl.
USPC ..... 181/166; 181/129; 181/130; 181/132; 181/135; 181/157

(58) Field of Classification Search
USPC ..... 181/129, 130, 132, 135, 157
See application file for complete search history.

(56) References Cited

U.S. PATENT DOCUMENTS 4,565,258 A * 1/1986 Butler et al. ..... 381/311
6,532,292 B1 * 3/2003 Lygas ..... 381/74
7,194,102 B2 3/2007 Harvey
7,194,103 B2 3/2007 Harvey
7,263,195 B2 8/2007 Harvey
7,317,806 B2 1/2008 Harvey
7,489,794 B2 2/2009 Harvey
7,634,099 B2 12/2009 Harvey
7,672,469 B2 3/2010 Harvey
7,864,975 B2 1/2011 Harvey
7,869,616 B2 1/2011 Harvey
7,876,920 B2 1/2011 Harvey
7,876,921 B2 1/2011 Harvey
7,882,928 B2 * 2/2011 McMahon et al. ..... 181/135
8,047,207 B2 * 11/2011 Perez et al. ..... 128/864
8,194,911 B2 * 6/2012 Dyer et al. ..... 381/382
8,208,644 B2 * 6/2012 Goldstein et al. ..... 381/56
2006/0222185 A1 10/2006 Harvey
2007/0201717 A1 8/2007 Harvey
2008/0181443 A1 7/2008 Harvey
2009/0041262 A1 2/2009 Harvey

* cited by examiner

*Primary Examiner* — Forrest M Phillips
(74) *Attorney, Agent, or Firm* — Douglas J. Visnius

(57) ABSTRACT

A canalphone system may include a high frequency sound bore carried within a canalphone. The system may also include a low frequency sound bore adjacent to the high frequency sound bore to form a single unit, the low frequency sound bore and the high frequency sound bore being sized so that the low frequency sound bore and the high frequency sound bore each deliver sound with similar time and phase. The system may further include a high acoustical driver carried within the canalphone where the high acoustical driver delivers sound through the high frequency sound bore. The system may additionally include a low acoustical driver carried within the canalphone where the low acoustical driver delivers sound through the low frequency sound bore.

20 Claims, 5 Drawing Sheets

DUAL BORE CANALPHONE SYSTEM

BACKGROUND OF THE INVENTION

1. Field of the Invention

The invention relates to the field of canalphones.

2. Description of Background

There are many different types of personal listening devices such as headphones, earbuds, canalphones, and/or the like. Headphones are personal listening devices that are held in close proximately to the ear by some support system. Earbuds are small personal listening devices that are positioned directly in front of the ear canal and are substantially smaller than a person's outer ear. Similarly, canalphones are personal listening devices that are substantially smaller than a person's outer ear, but they differ from earbuds in that they are placed directly in one end of the ear canal. Both earbuds and canalphones are held in positioned by friction between the ear and the device rather than the support system found in most headphones.

Canalphones are also referred to as in-ear monitors due to how the canalphone is worn by a listener. In other words, a canalphone is worn in the ear of the user and not over and/or around the ear of the user. Some canalphones also serve as earplugs due to the way the canalphone limits noise external to the canalphone from entering the ear canal.

SUMMARY OF THE INVENTION

According to one embodiment of the invention, a canalphone system may include a high frequency sound bore carried within a canalphone. The system may also include a low frequency sound bore carried within the canalphone that is adjacent to the high frequency sound bore to form a single unit prior to the sound bores being introduced to the canalphone, the low frequency sound bore and the high frequency sound bore being sized so that the low frequency sound bore and the high frequency sound bore each deliver sound with correct time and phase. The system may further include a high acoustical driver carried within the canalphone where the high acoustical driver delivers sound through the high frequency sound bore. The system may additionally include a low acoustical driver carried within the canalphone where the low acoustical driver delivers sound through the low frequency sound bore.

The low acoustical driver may comprise two low acoustical drivers. The high acoustical driver may comprise two high acoustical drivers.

The low frequency sound bore and/or the high frequency sound bore may carry an acoustical damper. The acoustical damper may be positioned without any rubber boot.

The low frequency sound bore and/or the high frequency sound bore may have extended lengths to reduce each sound bore's diameter. The high frequency sound bore's extended length may be greater than 3 millimeters.

The single unit may aid in the assembly of the canalphone. The single unit may be positioned at an angle between 30 degrees and 65 degrees with respect to the high acoustical driver and the low acoustical driver. The system may further include a resistor on the high acoustical driver to tune the high acoustical driver.

In another embodiment, the system may include a high frequency sound bore carried within a canalphone. The system may also include a low frequency sound bore carried within the canalphone that is adjacent to the high frequency sound bore to form a single unit prior to the sound bores being introduced to the canalphone, the low frequency sound bore and the high frequency sound bore being sized so that the low frequency sound bore and the high frequency sound bore each deliver sound with correct time and phase, and where the low frequency sound bore and the high frequency sound bore have extended lengths to reduce each sound bore's diameter. The system may further include a high acoustical driver carried within the canalphone where the high acoustical driver delivers sound through the high frequency sound bore. The system may additionally include a low acoustical driver carried within the canalphone where the low acoustical driver delivers sound through the low frequency sound bore, and the single unit is positioned at an angle between 30 degrees and 65 degrees with respect to the high acoustical driver and the low acoustical driver.

Another aspect of the invention is a method for improving a canalphone system. The method may include positioning a high acoustical driver within a canalphone. The method may also include positioning a low acoustical driver within the canalphone adjacent to the high acoustical driver. The method may further include positioning a single unit comprising a low frequency sound bore adjacent to a high frequency sound bore within the canalphone where the low frequency sound bore and the high frequency sound bore are sized so that the low frequency sound bore and the high frequency sound bore each deliver sound with correct time and phase, and the single unit adjoins both the high acoustical driver and low acoustical driver.

The method may additionally include inserting an acoustical damper within at least one of the low frequency sound bore and the high frequency sound bore. The method may also include inserting the acoustical damper within the sound bore without any rubber boot. The method may further include reducing the low frequency sound bore's diameter and the high frequency sound bore's diameter by extending the lengths of each sound bore.

DETAILED DESCRIPTION OF THE INVENTION

The invention will now be described more fully hereinafter with reference to the accompanying drawings, in which preferred embodiments of the invention are shown. Like numbers refer to like elements throughout, and like numbers with letter suffixes are used to identify similar parts in a single embodiment.

Figure 1:
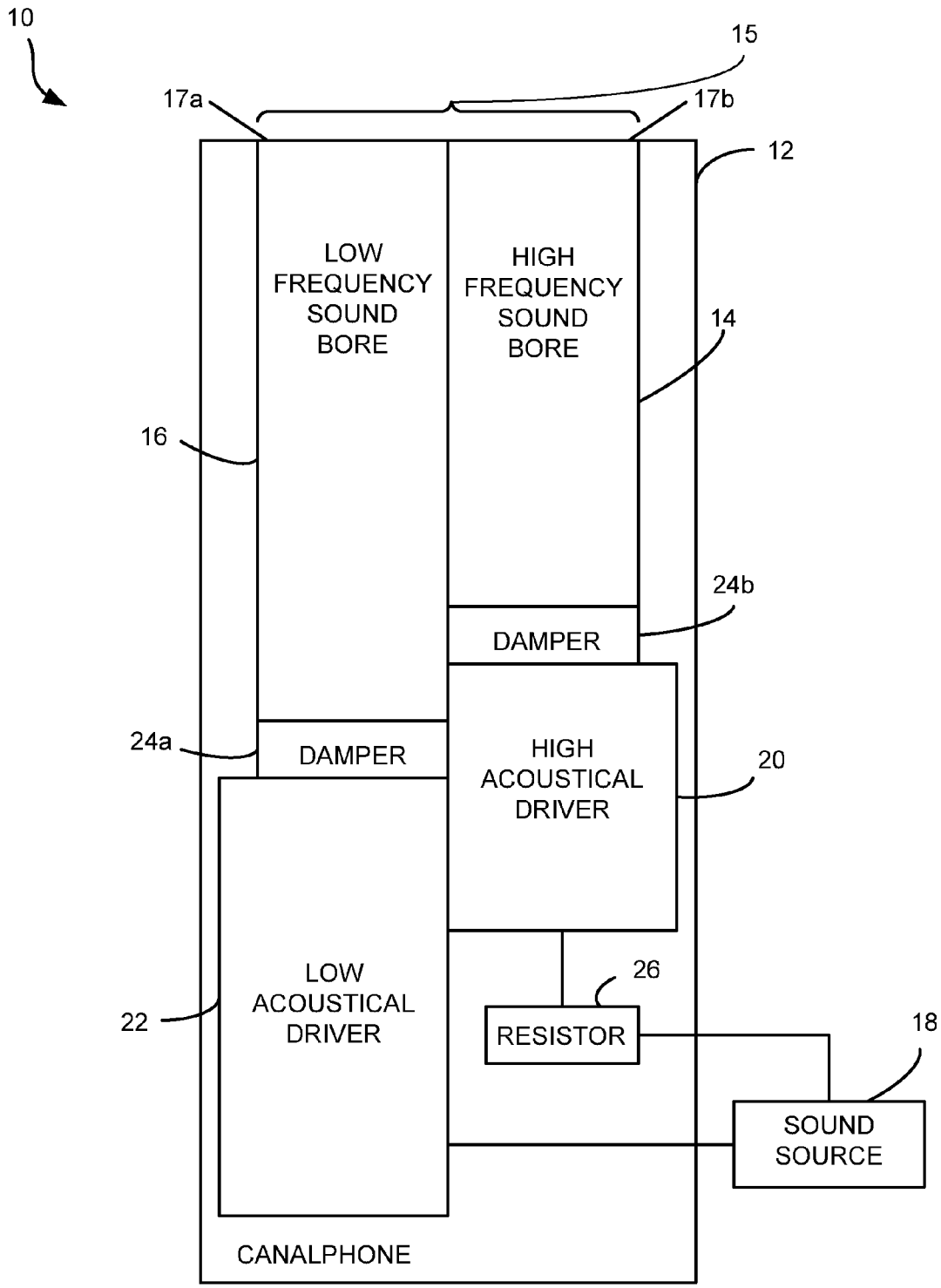
FIG. 1 is a schematic block diagram of a system in accordance with the invention.

With reference now to FIG. 1, a dual bore canalphone system 10 is initially described. The system 10 is carried by a canalphone housing 12 that frictionally engages the ear of a user (not shown) in its usage position as will be appreciated by those of skill in the art. In one embodiment, the system 10 includes a canalphone outlet 17*a* and 17*b* as will be appreciated by those of skill in the art.

In one embodiment, the system 10 includes a high frequency sound bore 14 carried within the canalphone 12. The system 10 also include a low frequency sound bore 16 carried within the canalphone 12 that is adjacent to the high frequency sound bore 14 to form a single unit 15 prior to the sound bores being introduced to the canalphone, the low frequency sound bore and the high frequency sound bore being sized so that the low frequency sound bore and the high frequency sound bore each deliver sound 18 with correct time and phase.

For example, the sizing of the low frequency sound bore 16 and the high frequency sound bore 14 involves selecting the diameter and/or length of each sound bore to provide the correct time and phase of sound 18 through the two sound bores with respect to each other. In other words, correct time and phase of the sound 18 through the low frequency sound bore 16 and the high frequency sound bore 14 as acoustically perceived by one using the system 10.

The system 10 further includes a high acoustical driver 20 carried within the canalphone where the high acoustical driver delivers sound 18 through the high frequency sound bore 14. The system 10 additionally include a low acoustical driver 22 carried within the canalphone 12 where the low acoustical driver delivers sound 18 through the low frequency sound bore.

In one embodiment, the low acoustical driver 22 comprises two low acoustical drivers. In another embodiment, the high acoustical driver 20 comprises two high acoustical drivers.

In one embodiment, the low frequency sound bore 16 and/or the high frequency sound bore 14 carry an acoustical damper 24*a* and 24*b*. In another embodiment, the acoustical damper 24*a* and 24*b* is positioned without any rubber boot (not shown).

In one embodiment, the low frequency sound bore 16 and/or the high frequency sound bore 14 have extended lengths to reduce each sound bore's diameter. Stated another way, the acoustical characteristics of either bore is preserved when reducing the bore's diameter by extending the bore's overall length. An advantage of the reduction of the two bores' diameter is that a user of system 10 can have a physically smaller ear canal. Stated another way, a physically smaller person usually has a smaller ear canal than a physically larger person, and system 10 can properly fit the physically smaller ear canal because of its reduced bore diameters while other canalphone systems currently available do not fit such individuals. In another embodiment, the high frequency sound bore's 14 extended length is greater than 3 millimeters.

In one embodiment, the single unit 15 aids in the assembly of the canalphone. Stated another way, because the single unit 15 is one piece, the installation of the single unit into the canalphone 12 is easier than trying to install the low frequency sound bore 16 and the high frequency sound bore 14 as separate components. In another embodiment, the single unit 15 is positioned at an angle between 30 degrees and 65 degrees with respect to the high acoustical driver 20 and the low acoustical driver 22. In another embodiment, the system 10 includes a resistor 26 on the high acoustical driver 20 to tune the high acoustical driver.

In another embodiment, the system 10 includes a high frequency sound bore 14 carried within the canalphone 12. The system also includes a low frequency sound bore 16 carried within the canalphone 12 that is adjacent to the high frequency sound bore 14 to form a single unit 15 prior to the sound bores being introduced to the canalphone, the low frequency sound bore and the high frequency sound bore being sized so that the low frequency sound bore and the high frequency sound bore each deliver sound 18 with correct time and phase, and where the low frequency sound bore and the high frequency sound bore have extended lengths to reduce each sound bore's diameter. The system further includes a high acoustical driver 20 carried within the canalphone 12 where the high acoustical driver delivers sound 18 through the high frequency sound bore 14. The system additionally include a low acoustical driver 22 carried within the canalphone 22 where the low acoustical driver delivers sound 18 through the low frequency sound bore 16, and the single unit 15 is positioned at an angle between 30 degrees and 65 degrees with respect to the high acoustical driver 14 and the low acoustical driver.

Figure 2:
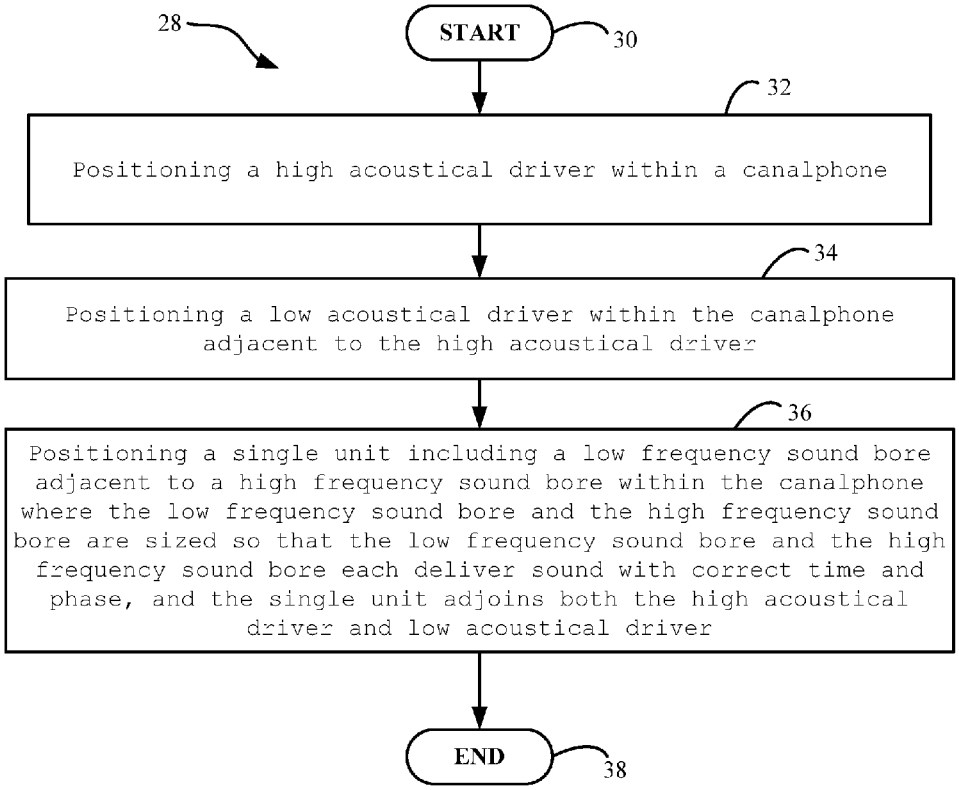
FIG. 2 is a flowchart illustrating method aspects according to the invention.

Another aspect of the invention is a method for improving a canalphone system, which is now described with reference to flowchart 28 of FIG. 2. The method begins at Block 30 and may include positioning a high acoustical driver within a canalphone at Block 32. The method may also include positioning a low acoustical driver within the canalphone adjacent to the high acoustical driver at Block 34. The method may further include positioning a single unit including a low frequency sound bore adjacent to a high frequency sound bore within the canalphone where the low frequency sound bore and the high frequency sound bore are sized so that the low frequency sound bore and the high frequency sound bore each deliver sound with correct time and phase, and the single unit adjoins both the high acoustical driver and low acoustical driver at Block 36. The method ends at Block 38.

Figure 3:
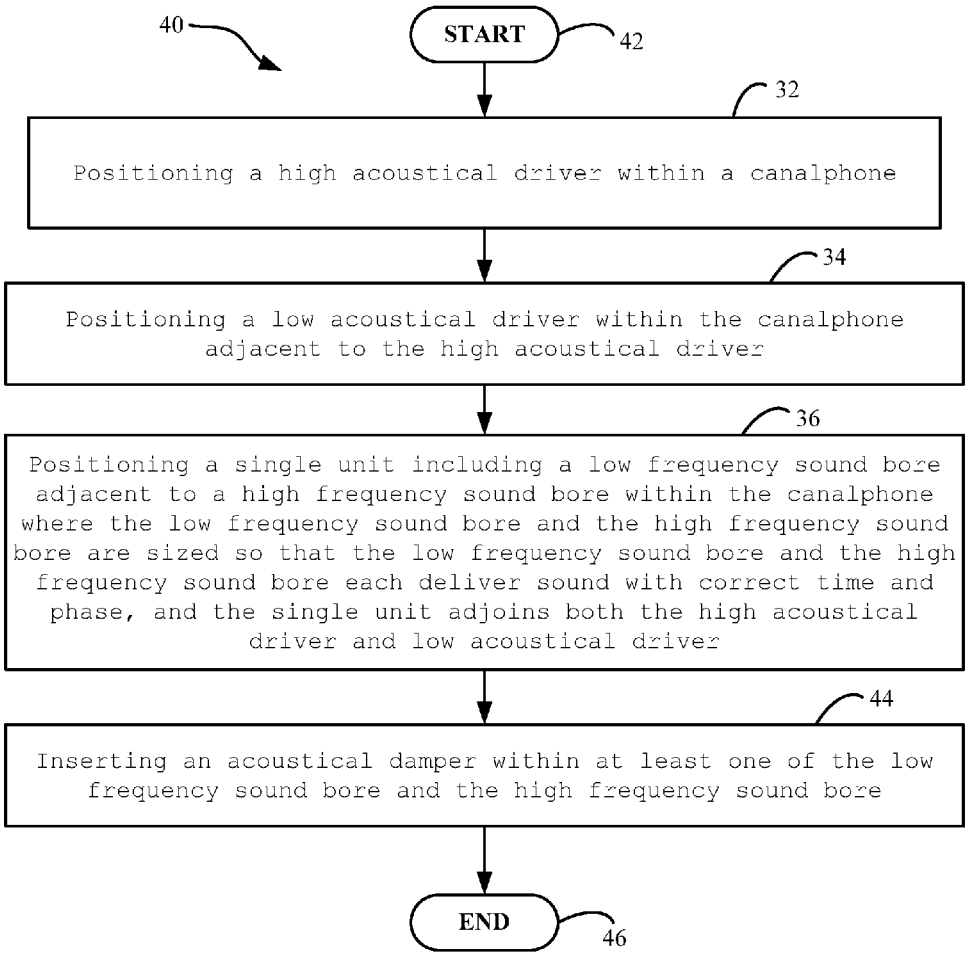
FIG. 3 is a flowchart illustrating method aspects according to the method of FIG. 2.

In another method embodiment, which is now described with reference to flowchart 40 of FIG. 3, the method begins at Block 42. The method may include the steps of FIG. 2 at Blocks 32, 34, and 36. The method may further include inserting an acoustical damper within at least one of the low frequency sound bore and the high frequency sound bore at Block 44. The method ends at Block 46.

Figure 4:
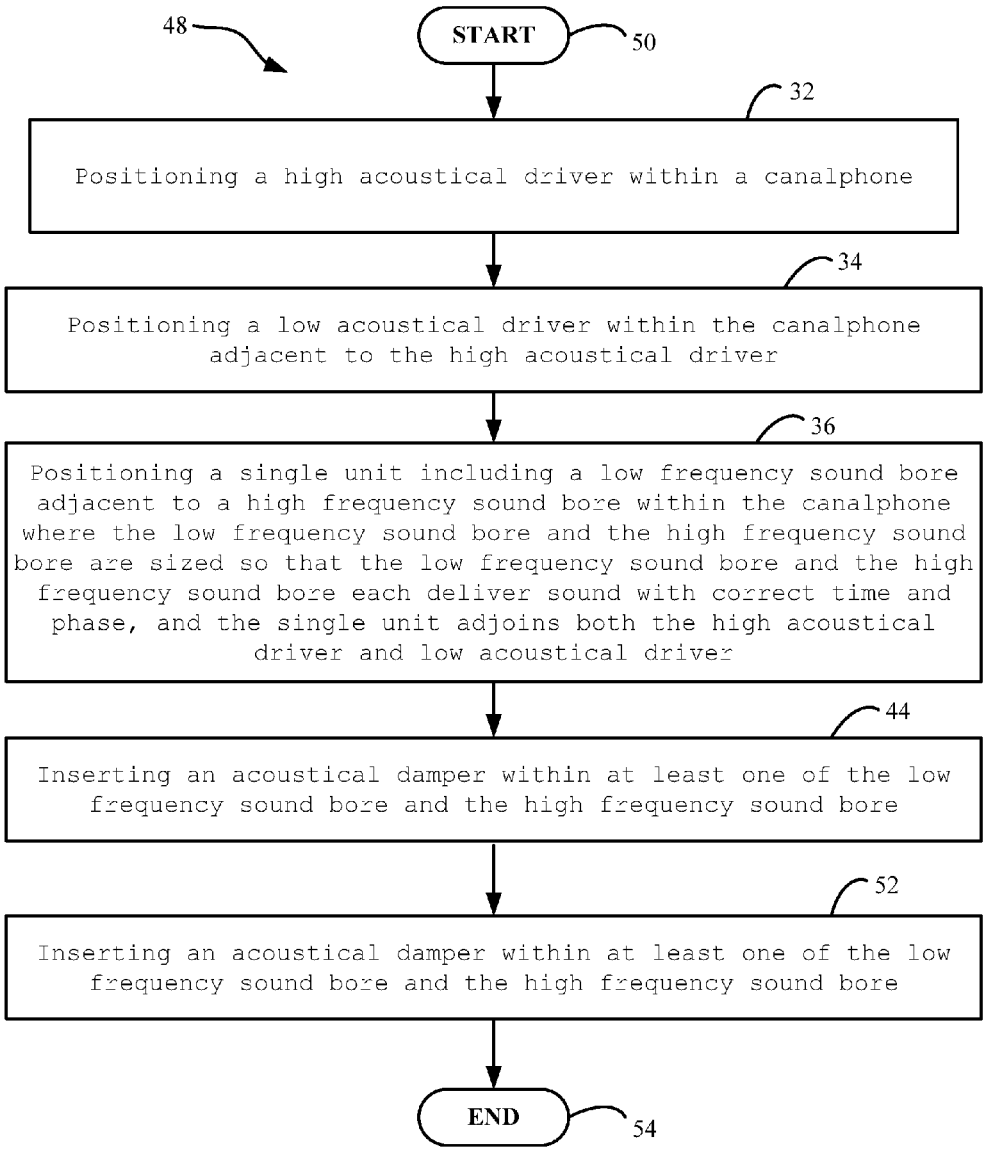
FIG. 4 is a flowchart illustrating method aspects according to the method of FIG. 3.

In another method embodiment, which is now described with reference to flowchart 48 of FIG. 4, the method begins at Block 50. The method may include the steps of FIG. 3 at Blocks 32, 34, 36, and 44. The method may also include inserting the acoustical damper within the sound bore without any rubber boot at Block 52. The method ends at Block 54.

Figure 5:
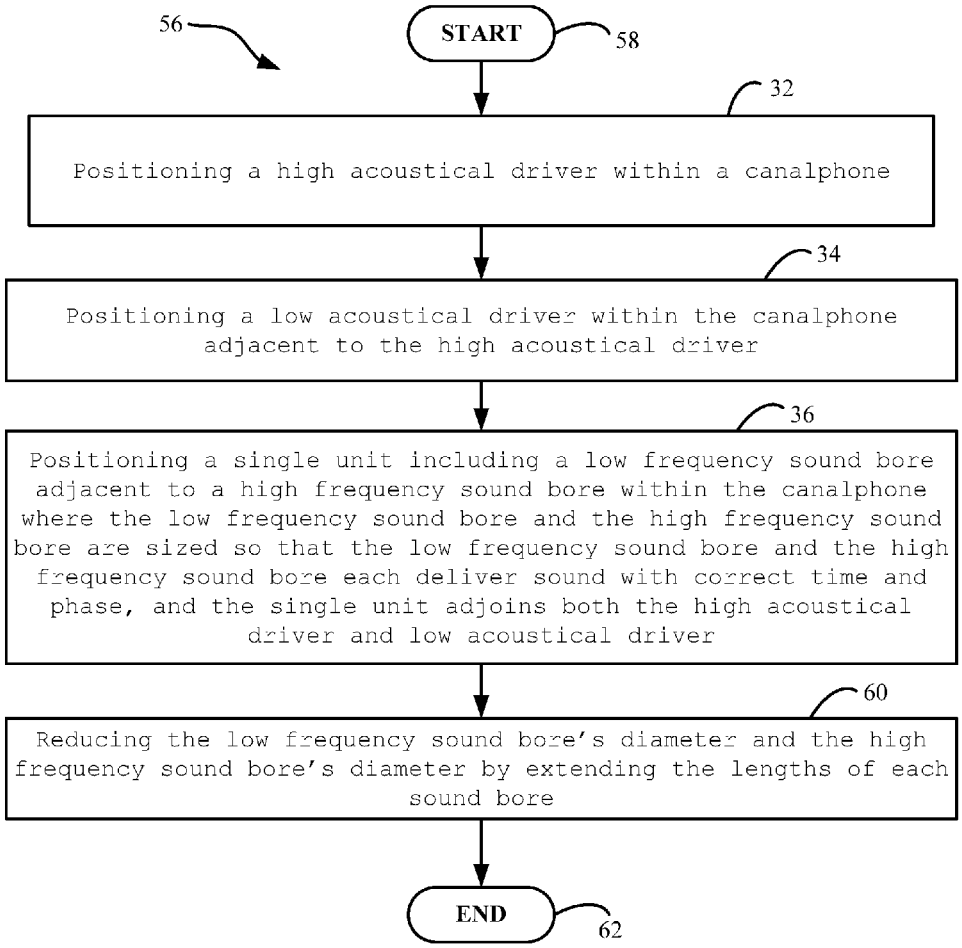
FIG. 5 is a flowchart illustrating method aspects according to the method of FIG. 2.

In another method embodiment, which is now described with reference to flowchart 56 of FIG. 5, the method begins at Block 58. The method may include the steps of FIG. 2 at Blocks 32, 34, and 36. The method may further include reducing the low frequency sound bore's diameter and the high frequency sound bore's diameter by extending the lengths of each sound bore at Block 60. The method ends at Block 62.

Since a canalphone housing is very small, it is very difficult to achieve any of the preceding embodiments. However, system 10 overcomes the technical hurdles of providing more components in less space, providing superior sound reproduction, and a reduction in assembly time when compared to a standard canalphone system.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A system comprising:

a high acoustical driver carried within a canalphone;

a low acoustical driver carried within the canalphone;

a one piece high frequency sound bore carried within the canalphone; and a one-piece low frequency sound bore adjoining the high frequency sound bore to form a single unit prior to the sound bores being introduced to the canalphone, the one-piece low frequency sound bore and the one-piece high frequency sound bore each sized to fit between the low acoustical driver and the high acoustical driver, respectively, the high acoustical driver to deliver sound through the one-piece high frequency sound bore to the canalphone's outlet and the low acoustical driver to deliver sound through the one-piece low frequency sound bore to the canalphone's outlet.

2. The system of claim 1 wherein the low acoustical driver comprises two low acoustical drivers.

3. The system of claim 2 wherein the high acoustical driver comprises two high acoustical drivers.

4. The system of claim 1 wherein at least one of the low frequency sound bore and the high frequency sound bore carries an acoustical damper.

5. The system of claim 4 wherein the acoustical damper is positioned without any rubber boot.

6. The system of claim 1 wherein the low frequency sound bore and the high frequency sound bore have extended lengths to reduce each sound bore's diameter.

7. The system of claim 6 wherein the high frequency sound bore's extended length is greater than 3 millimeters.

8. The system of claim 1 wherein the single unit aids in the assembly of the canalphone.

9. The system of claim 1 further comprising a resistor on the high acoustical driver to tune the high acoustical driver.

10. The system of claim 1 wherein the single unit is positioned at an angle between 30 degrees and degrees with respect to the high acoustical driver and the low acoustical driver.

11. A system comprising:

a high acoustical driver carried within a canalphone;

a low acoustical driver carried within the canalphone;

a one piece high frequency sound bore carried within the canalphone; and a one-piece low frequency sound bore adjoining the high frequency sound bore to form a single unit prior to the sound bores being introduced to the canalphone, the one-piece low frequency sound bore and the one-piece high frequency sound bore each sized to fit between the low acoustical driver and the high acoustical driver, respectively, and the low frequency sound bore and the high frequency sound bore have extended lengths to reduce each sound bore's diameter, the high acoustical driver to deliver sound through the one-piece high frequency sound bore to the canalphone's outlet the low acoustical driver to deliver sound through the one-piece low frequency sound bore to the canalphone's outlet, and the single unit is positioned at an angle between 30 degrees and 65 degrees with respect to the high acoustical driver and the low acoustical driver.

12. The system of claim 11 wherein at least one of the low frequency sound bore and the high frequency sound bore carries an acoustical damper where the acoustical damper is positioned without any rubber boot.

13. The system of claim 11 wherein the low acoustical driver comprises two low acoustical drivers.

14. The system of claim 13 wherein the high acoustical driver comprises two high acoustical drivers.

15. The system of claim 11 wherein the high frequency sound bore's extended length is greater than 3 millimeters.

16. The system of claim 11 further comprising a resistor on the high acoustical driver to tune the high acoustical driver.

17. A method comprising:

positioning a high acoustical driver within a canalphone;

positioning a low acoustical driver within the canalphone adjoining the high acoustical driver;

positioning a single unit including a one-piece low frequency sound bore adjoining a one-piece high frequency sound bore within the canalphone where the one-piece low frequency sound bore and the one-piece high frequency sound bore are each sized to fit between the low acoustical driver and the high acoustical driver, respectively, and the single unit adjoins both the high acoustical driver and low acoustical driver.

18. The method of claim 17 further comprising inserting an acoustical damper within at least one of the low frequency sound bore and the high frequency sound bore.

19. The method of claim 18 further comprising inserting the acoustical damper within the sound bore without any rubber boot.

20. The method of claim 17 further comprising reducing the low frequency sound bore's diameter and the high frequency sound bore's diameter by extending the lengths of each sound bore.

* * * * *

(12) INTER PARTES REVIEW CERTIFICATE (1853rd)

United States Patent
Harvey

(10) Number: US 8,567,555 K1
(45) Certificate Issued: Sep. 25, 2020

(54) DUAL BORE CANALPHONE SYSTEM

(75) Inventor: Jerry Harvey

(73) Assignee: JERRY HARVEY AUDIO HOLDING, LLC

Trial Number:

IPR2017-01084 filed Mar. 15, 2017

Inter Partes Review Certificate for:

Patent No.: 8,567,555
Issued: Oct. 29, 2013
Appl. No.: 13/315,610
Filed: Dec. 9, 2011

The results of IPR2017-01084 are reflected in this inter partes review certificate under 35 U.S.C. 318(b).

INTER PARTES REVIEW CERTIFICATE
U.S. Patent 8,567,555 K1
Trial No. IPR2017-01084
Certificate Issued Sep. 25, 2020

AS A RESULT OF THE INTER PARTES REVIEW PROCEEDING, IT HAS BEEN DETERMINED THAT:

Claims 1-20 are cancelled.

* * * * *